US006089775A

United States Patent [19]

Yokouchi

[11] Patent Number: 6,089,775

[45] Date of Patent: Jul. 18, 2000

[54] RETRACTABLE-LEAD MECHANICAL PENCIL

[75] Inventor: Nobuo Yokouchi, Kasukabe, Japan

[73] Assignee: Pentel Kabushiki Kaisha, Japan

[21] Appl. No.: 09/155,492

[22] PCT Filed: Jan. 28, 1998

[86] PCT No.: PCT/JP98/00335

§ 371 Date: Sep. 28, 1998

§ 102(e) Date: Sep. 28, 1998

[87] PCT Pub. No.: WO98/33662

PCT Pub. Date: Aug. 6, 1998

[30] Foreign Application Priority Data

Jan. 31, 1997 [JP] Japan ..... 9-32977

[51] Int. Cl.[7] ..... B43K 21/16

[52] U.S. Cl. ..... 401/65; 401/99; 401/67

[58] Field of Search ..... 401/94, 99, 31, 401/65, 67

[56] References Cited

U.S. PATENT DOCUMENTS

| | | | |
|---|---|---|---|
| 3,001,510 | 9/1961 | Chelazzi | 401/94 |
| 3,450,482 | 6/1969 | Dorstewitz | 401/67 |
| 3,724,960 | 4/1973 | Hashimoto et al. | 401/67 |
| 4,106,874 | 8/1978 | Torii | 401/67 |

FOREIGN PATENT DOCUMENTS

| | | | |
|---|---|---|---|
| 231521 | 8/1987 | European Pat. Off. | 401/99 |
| 604721 | 5/1960 | Italy | 401/67 |
| 54-14524 | 6/1979 | Japan . | |
| 54-24324 | 8/1979 | Japan . | |
| 56-29168 | 7/1981 | Japan . | |
| 63-132783 | 8/1988 | Japan . | |
| 3-35588 | 7/1991 | Japan . | |
| 3-46943 | 10/1991 | Japan . | |
| 8-1908 | 1/1996 | Japan . | |
| 954279 | 4/1964 | United Kingdom | 401/99 |

*Primary Examiner*—David J. Walczak
*Attorney, Agent, or Firm*—Adams & Wilks

[57] ABSTRACT

A slider type mechanical pencil has an outer tubular member having a front end and a rear end. An inner tubular member is disposed in the outer tubular member for axial movement therein and has a lead advancement mechanism for axial movement within the outer tubular member to advance a pencil lead toward the front end of the outer tubular member. A slider has a first end portion projecting from the rear end of the outer tubular member and a second end portion. The slider extends into the outer tubular member so that the first end portion of the slider can be pressed in the axial direction relative to the outer tubular member to move the inner tubular member and the lead advancement mechanism in the axial direction toward the front end of the outer tubular member. A pusher member extends into the outer tubular member for axial movement therein and has a first end portion projecting from the rear end of the outer tubular member and a second end portion. The pusher member extends into the slider so that in a first position of the pusher member, the first end portion of the pusher member and the first end portion of the slider can be simultaneously pressed to move the inner tubular member and the lead advancement mechanism in the axial direction relative to the outer tubular member. In a second position of the pusher member, the first end portion of the pusher member projects from the first end portion of the slider and can be pressed to move the lead advancement mechanism in the axial direction relative to the slider, the inner tubular member and the outer tubular member to advance the pencil lead toward the front end of the outer tubular member.

5 Claims, 5 Drawing Sheets

RETRACTABLE-LEAD MECHANICAL PENCIL

TECHNICAL FIELD OF THE INVENTION

This invention relates to a slider type writing implement having a plurality of cam grooves formed in a rear inner surface of an outer tubular shell, a rotor slidably/rotatably disposed within the cam grooves, and a slider for pushing and rotating the rotor.

BACKGROUND OF THE INVENTION

One example of a known writing implement of the above type is disclosed in Japanese Patent Examined Publication No. 54-14524/1979. According to the teaching of this publication, the device has a tip pipe whose tip portion projects from a forward end of a body to protect a writing lead and a content including an inside ferrule containing therein a lead retainer, a chuck and a fastening device, a fastening device retainer disposed on the inside ferrule, a lead case connected to the chuck, etc. The tip pipe and the content are capable of back and forth movements within the body. A rear end of the fastening device retainer is retained by a mechanism such that the retainer is locked in an advanced position by a first knocking operation and in a retracted position by a second knocking operation. A first spring is interposed between the body and the lead case, and a second spring is interposed between the body and the fastening device retainer. With this construction, a mechanical pencil having a content advancement/retraction mechanism is characterized in that the content is locked in the advanced position by a first large knocking operation, then the writing lead is advanced by a small knocking operation, and the content is locked in the retracted position (or received in place) by a second large knocking operation. In other words, according to the conventional construction mentioned above, the content can be exposed or withdrawn (by a large knocking operation) and the writing lead can be advanced (by a small knocking operation) by properly selecting the modes of the knocking operations.

However, in the above conventional technique, it is required for the user to determine a pressing amount of a knock cap either by guessing or by watching a stepped portion of the knock cap when one of the knocking modes (i.e., a large knocking operation and a small knocking operation) is to be selected.

Obviously, it is difficult for the user to determine the pressing amount of the knock cap by guessing. It sometimes happens that a large knocking operation is made by mistake while a small knocking operation (writing lead advancement operation) is intended. The result is that the content is withdrawn, thus giving an unpleasant feel to the user unable to write. Furthermore, a pressing amount determination operation by watching the stepped portion is convenient because it requires causes the user to watch the knock cap sideways each time the knocking operation is required.

SUMMARY OF THE INVENTION

The present invention has been accomplished in view of the abovementioned problems. It is, therefore, an object of the present invention to provide an improved slider type mechanical pencil, in which the abovementioned shortcomings inherent in the conventional construction are obviated.

It is another object of the invention to provide an improved mechanical pencil, in which a large knocking operation and a small knocking operation can be selectively made with the feel of a finger in a reliable manner and therefore, a favorable sliding operation and a favorable writing operation can be obtained.

The first feature of the present invention resides in a slider type mechanical pencil having a plurality of cam grooves formed in a rear inner surface of an outer tubular shell, a rotor slidably/rotatably disposed within the cam grooves, and a slider for pushing and rotating the rotor, wherein an inner tubular shell having a lead advancement mechanism is disposed ahead of the rotor in abutment relation with the rotor, and a pusher member for sliding on an inner surface of the slider in order to push and rotate the rotor and actuating the lead advancement mechanism is disposed within the slider such that the pusher member can be projected from the slider.

The second feature of the present invention resides in a slider type mechanical pencil having an inner tubular shell slidably disposed within an outer tubular shell and containing therein a lead advancement mechanism, wherein a slider is disposed within the outer tubular shell with a part of the slider projected from a rear part of the outer tubular shell such that the slider is capable of pushing the inner tubular shell, and a pusher member for sliding on an inner surface of the slider and actuating the lead advancement mechanism is disposed within the slider such that the pusher member can be projected from the slider.

DETAILED DESCRIPTION OF THE PREFERRED EMBODIMENTS

Figure 1:
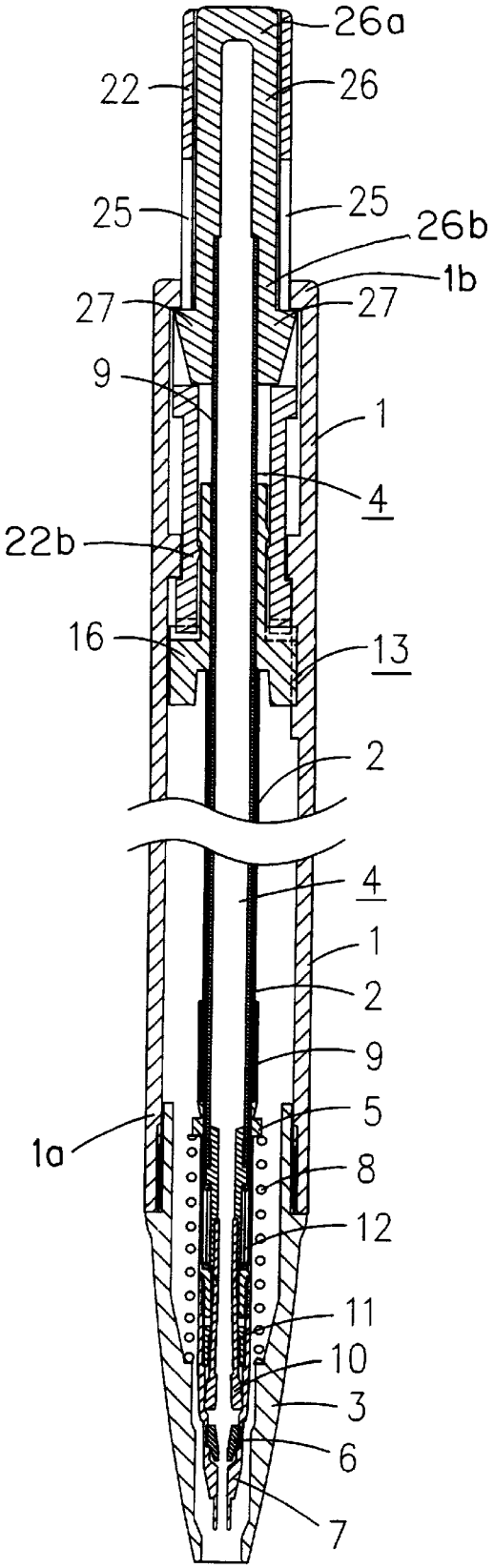
FIG. 1 is a vertical sectional view of a mechanical pencil (when a writing lead is withdrawn) according to one preferred embodiment (first embodiment) of the present invention.
Figure 2:
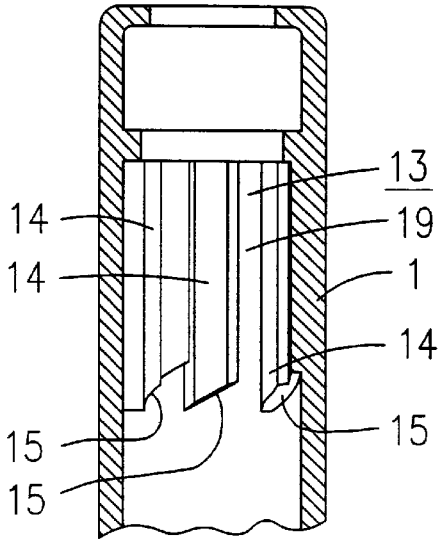
FIG. 2 is a front view of an essential portion showing a cam of FIG. 1.
Figure 3:
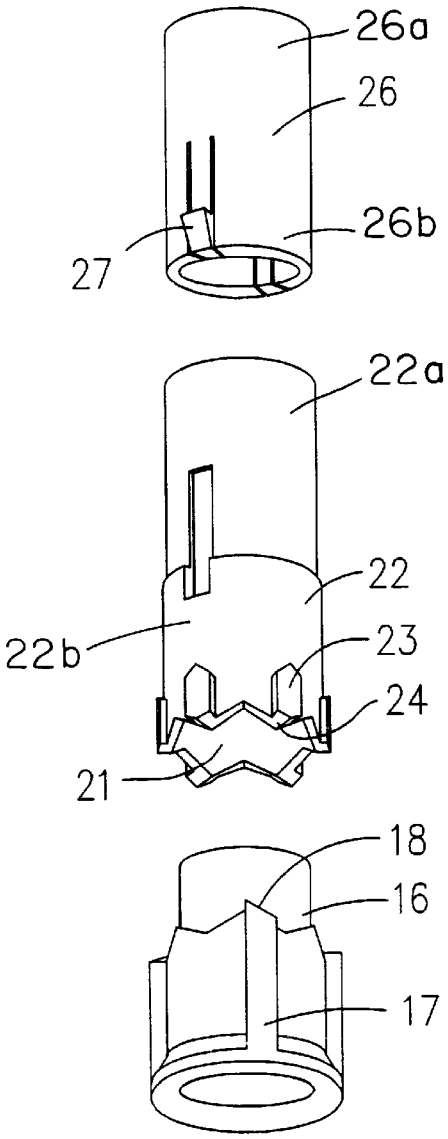
FIG. 3 is an exploded perspective view of a cam mechanism shown in Fig. 1.
Figure 4:
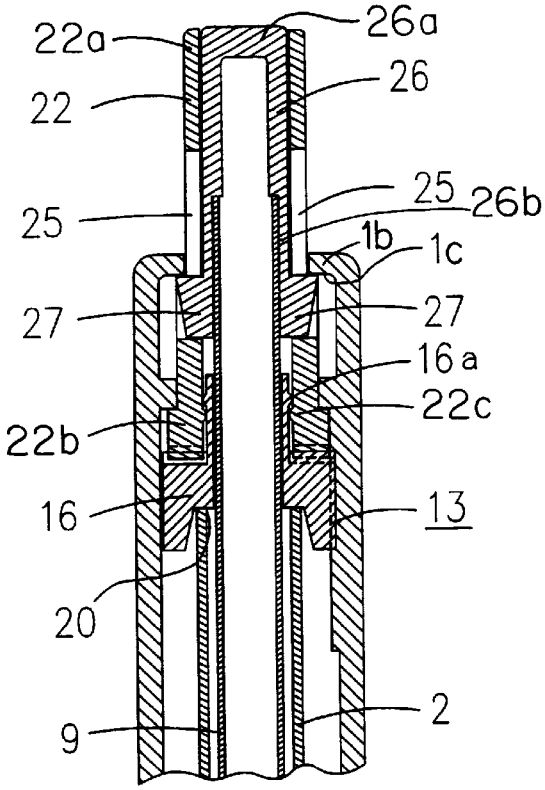
FIG. 4 is an enlarged view of an essential portion, when a writing lead is withdrawn, in the construction of FIG. 1.

FIGS. 1 to 4 show a first embodiment of the present invention. Within an outer tubular member or shell 1 having a front end 1*a* and a rear end 1*b*, shell 1, an inner tubular shell 2 is movably disposed for back and forth movements. A tip element 3 is detachably attached to a tip portion of the outer tubular shell 1 by screw means or the like. A lead advancement mechanism 4 is disposed within the inner tubular shell 2. A tip member 7 with a lead return stopper 6 provided inside thereof is detachably attached to a front end of the inner tubular shell 2 by screw means or the like through a connecting member 5. The inner tubular shell 2 having the lead advancement mechanism 4 is normally backwardly biased by a spring 8.

The lead advancement mechanism 4 includes a lead tank 9 for storing therein a plurality of writing leads, a chuck body 10 for clamping/releasing the writing lead fixed to a front end of the lead tank 10, a chuck ring 11 for opening/closing the chuck body 10, and a chuck spring 12 for normally backwardly biasing the lead advancement mechanism 4 in order to bring the chuck body 10 into its closed position, and some others. It should be noted that in this embodiment, the resilient force of the chuck spring 12 is set to be smaller than that of the spring 8.

On a rear inner surface of the outer tubular shell 1, a cam 13 is formed. Alternatively, the cam 13 may be formed of a separate member and then integrally formed on the outer tubular shell 1. The cam 13 consists of a plurality of lugs 14 vertically radially formed as illustrated. Each of the lugs 14 has a slanted surface 15 formed on a front end face thereof A rotor 16 is fitted to the cam 13. Lugs 17 are likewise formed on an outer peripheral surface of the rotor 16. Each of the lugs 17 has a beveled slanted- surface 18 formed on a rear end face thereof. The lugs 17 of the rotor 16 are brought into engagement with the slanted surfaces of the corresponding lugs 14 or fitted to corresponding grooves 19 defined between the adjacent lugs 14. When the lugs 17 of the rotor 16 are in engagement with the corresponding lugs 14 of the cam 13, the rotor 16 is located in an advanced position, and when the lugs 17 are fitted to the corresponding grooves 19, the rotor 16 is located in a retracted position. Because a rear end of the inner tubular shell 2 is in abutment (an abutment portion 20) with the rotor 16, the lead advancement mechanism 4 is projected from the tip portion of the outer tubular shell 1 when the rotor 16 is in the advanced position and the mechanism 4 is withdrawn when the rotor 16 is in the retracted position.

A hollow slider 22 having a first end portion 22*a* projecting from the rear end 1*a* of the outer tubular shell 1, a second end portion 22*b* and a hollow interior portion 21 as illustrated is located behind the rotor 16 for back and forth movements. Lugs 23 are likewise formed on an outer periphery of the slider 22. Each of the lugs 23 has likewise a beveled slanted- surface 24 formed on a front end face thereof. Vertical guide grooves 25 are formed in a side surface of the slider 22. Slidably fitted in the guide grooves 25 are corresponding resilient lugs 27 which are formed on a pusher member or body 26 which is slidably disposed in the hollow interior portion 21. The resilient lugs 27 are engageable with a ceiling 1*c* of the outer tubular shell 1 so that the pusher body 26 will not escape from the rear end of the outer tubular shell 1. The pusher body 26 has a first end portion 26*a* projecting from the rear end 1*a* of the outer tubular shell 1 and a second end portion 26*b*.

The rotors 16 and the slider 22 have protuberances 16*a* and 22*c* formed respectively on mating surfaces thereof, so that the range of movements of the rotor 16 and the slider 22 is limited. The back and forth movements (play) of the slider 22, when in the projected state, is also prevented as will be described in greater detail.

Operation for projecting the tip member 7 through advancement of the inner tubular shell 2 will now be described.

Figure 5:
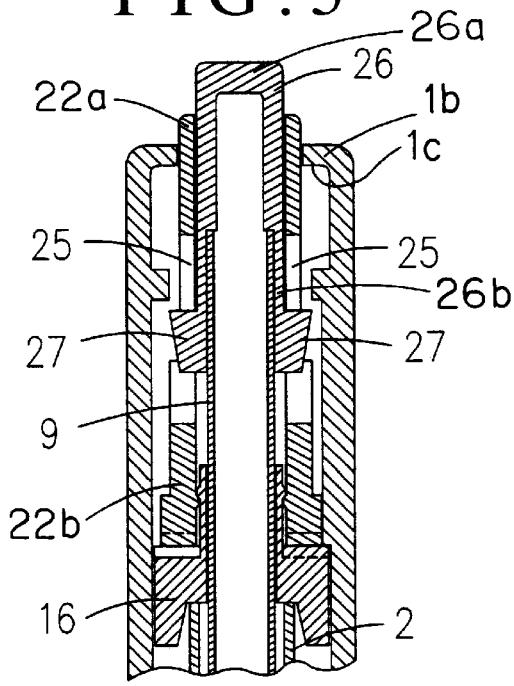
FIG. 5 is an enlarged view of the essential portion, when a writing lead is projected, in the construction of FIG. 1.

In the state of FIG. 1 (and FIG. 3), rear the first end portions 22*a* and 26*a* at ends of the pusher body 26 and the slider 22, respectively are pushed forwardly by a finger tip or the like. This causes the slider 22, the inner tubular shell 2, the lead advancement mechanism 4, etc. to advance against the resilient force of the springs 12 and 8. At that time, the rotor 16 is advanced by the slider 22 and also rotated by engagement between the beveled slanted- surface 24 of the slider 22 and the beveled slanted- surface 18 of the rotor 16. Then, the beveled slanted- surface of the rotor 16 is anchored on the slanted surface 15 of the cam 13 (see FIG. 5). By this, the tip member 7 of the inner tubular shell 2 is projected from the tip element 3 of the outer tubular shell 1. Subsequently, when the finger is removed from the rear ends of the pusher body 26 and the slider 22 (when the pushing operation is canceled), the pusher body 26 is retracted by the resilient force of the chuck spring 12. At that time, since the rotor 16 is locked in the advanced position, no retraction action is prevailed on the slider 22 and the pusher first end portion 26*a* of the body 26 is projected projected from the first end portion 22*a* of the slider 22.

At that time, the slider 22 is movable between the rotor 16 and the rear end of the outer tubular shell 1 but the slider 22 and the rotor 16 are not easily movable because they are retained by a small engagement force between the protuberances 16*a* and 22*c*.

Operation for advancing the writing lead will now be described. In the aforementioned projected state, the pusher body 26 is pushed by the finger tip until the finger tip contacts the rear end of the slider 22. When the finger tip contacts the rear end of the slider 22, the pushing operation is canceled. By such a pushing operation, the lead tank 9 is advanced and the chuck body 10 is also advanced against the resilient force of the chuck spring 12. The advancement of the chuck body 10 causes the writing lead to advance from the tip member 7.

Next, operation for withdrawing the tip element of the outer tubular shell 1 by retracting the inner tubular shell 2 will be described. In the aforementioned projected state, the pusher body 26 is pushed by the finger tip. Continuation of this pushing operation enables the finger tip to contact the rear end of the slider 22. The slider 22 is, in turn, pushed and advanced when the pushing operation is further continued. When the slider 22 is pushed and advanced, the rotor 16 is also rotationally advanced. When the rotor 16 is rotated, the engagement between the beveled slanted- surface 18 of the rotor 16 and the slanted surface 15 of the cam 13 is canceled and the lugs 17 each having the beveled- slanted surface 18 are brought into the corresponding grooves 19 of the cam 13. At that time, the rotor 22 is retracted along the grooves 19 by the resilient force of the spring 8 and the tip member 7 is withdrawn into the tip element 3.

In the lead advancement mechanism 4, when withdrawn in the outer tubular shell 1, the lead tank 9 is relatively pushed and the chuck body 10 is located in an open position. Owing to this arrangement, the writing lead is always received in place when withdrawn in the outer tubular shell 1 (see FIG. 1).

Figure 6:
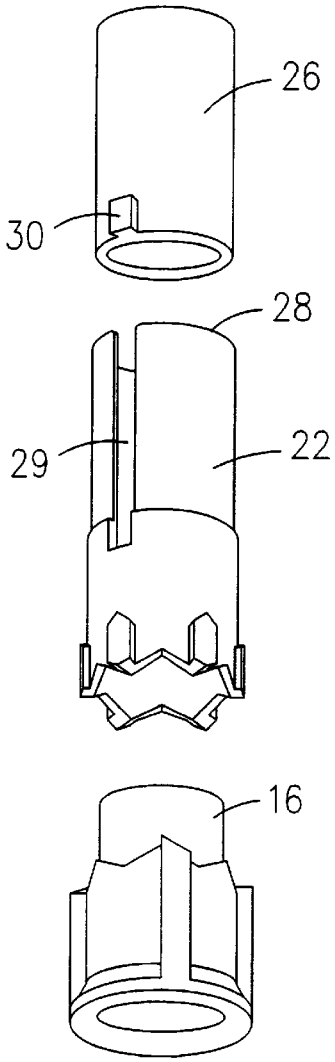
FIG. 6 is a perspective view showing a modified embodiment of the cam mechanism.

A modified example of the slider 22 and the pusher body 26 shown in FIG. 6 will now be described. This is a modified example of the groove of the slider 22 and the lug of the pusher body 26. Specifically, a guide groove 29 is formed backwardly in the slider 22 from an intermediate portion thereof to a rear end 28 thereof. A lug 30 to be fitted in the guide groove 29 is formed on a side surface of the pusher body 26. In this modified example, the machining to the guide groove and the lug can be made more easily than in the preceding embodiment and the manufacturing cost can be reduced.

Figure 7:
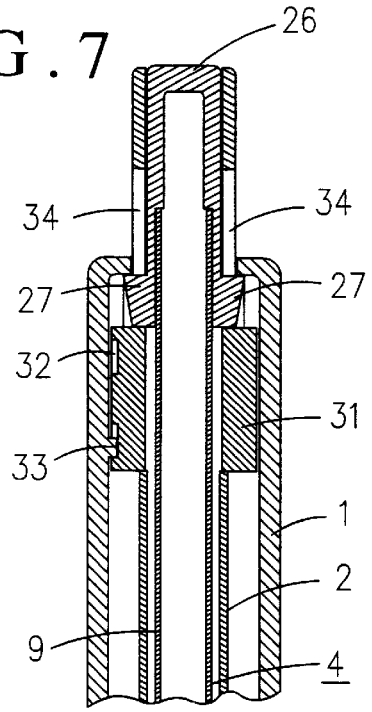
FIG. 7 is a vertical sectional view of an essential portion of a mechanical pencil according to a second embodiment of the present invention.
Figure 8:
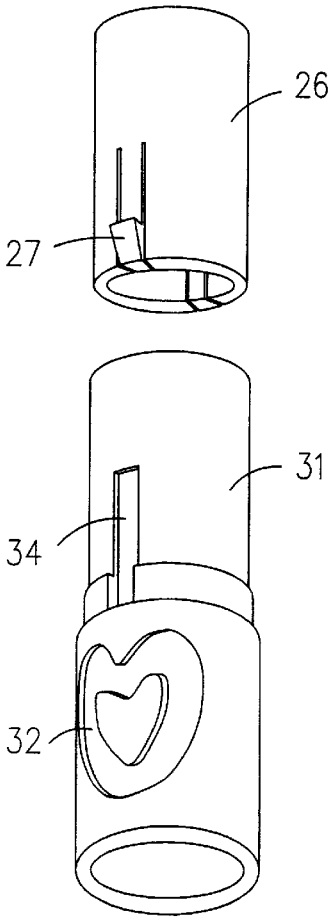
FIG. 8 is a perspective view of a cam mechanism in the construction of FIG. 7.

The second embodiment of the present invention will now be described with reference to FIGS. 7 and 8. A pressure rotor 31, which is in the form something like a combination of the rotor and the slider, is in abutment with the rear end of the inner tubular shell 2 with a rear end of the rotor 31 projected from the outer tubular shell 1. A cam groove 32 in the shape of a heart is formed in a forward surface of the pressure rotor 31. The cam groove 32 is in engagement with an engagement projection 33 which is formed on a backward inner surface of the outer tubular shell 1. Guide groove 34, which are like those in the preceding embodiment, are formed behind the pressure rotor 31. The resilient lugs 27 of the pusher body 26 are fitted in the corresponding guide grooves 34.

When the pusher body 26 and the pressure rotor 31 are pushed, the pressure rotor 31 is rotationally advanced by the heart- shaped cam mechanism. The advancement of the pressure rotor 31 causes the tip element on the tip portion of the inner tubular shell 2 to project from the tip member of the outer tubular shell 1.

Figure 9:
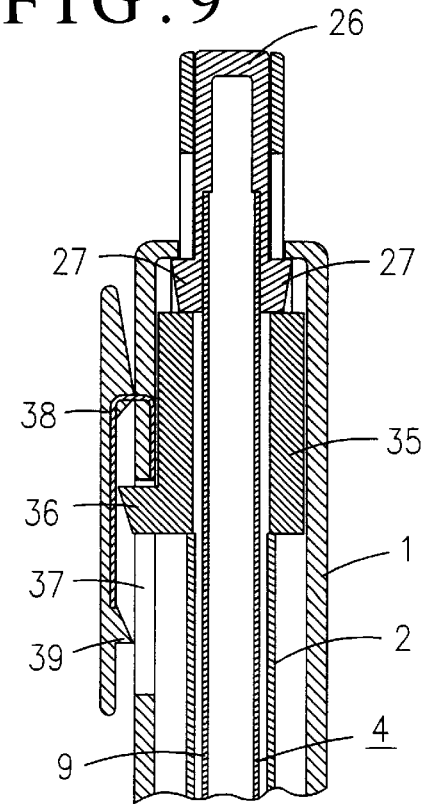
FIG. 9 is a vertical sectional view of an essential portion of a mechanical pencil according to a third embodiment of the present invention.
Figure 10:
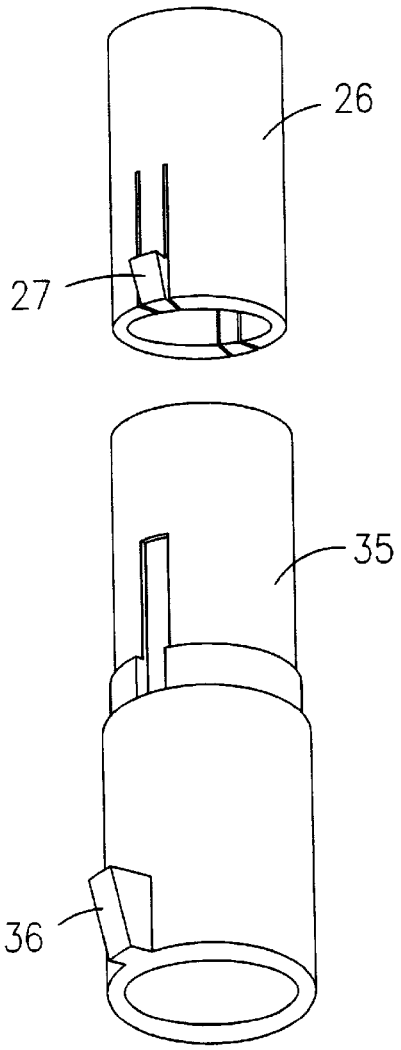
FIG. 10 is a perspective view of a cam mechanism of FIG. 9.
Figure 11:
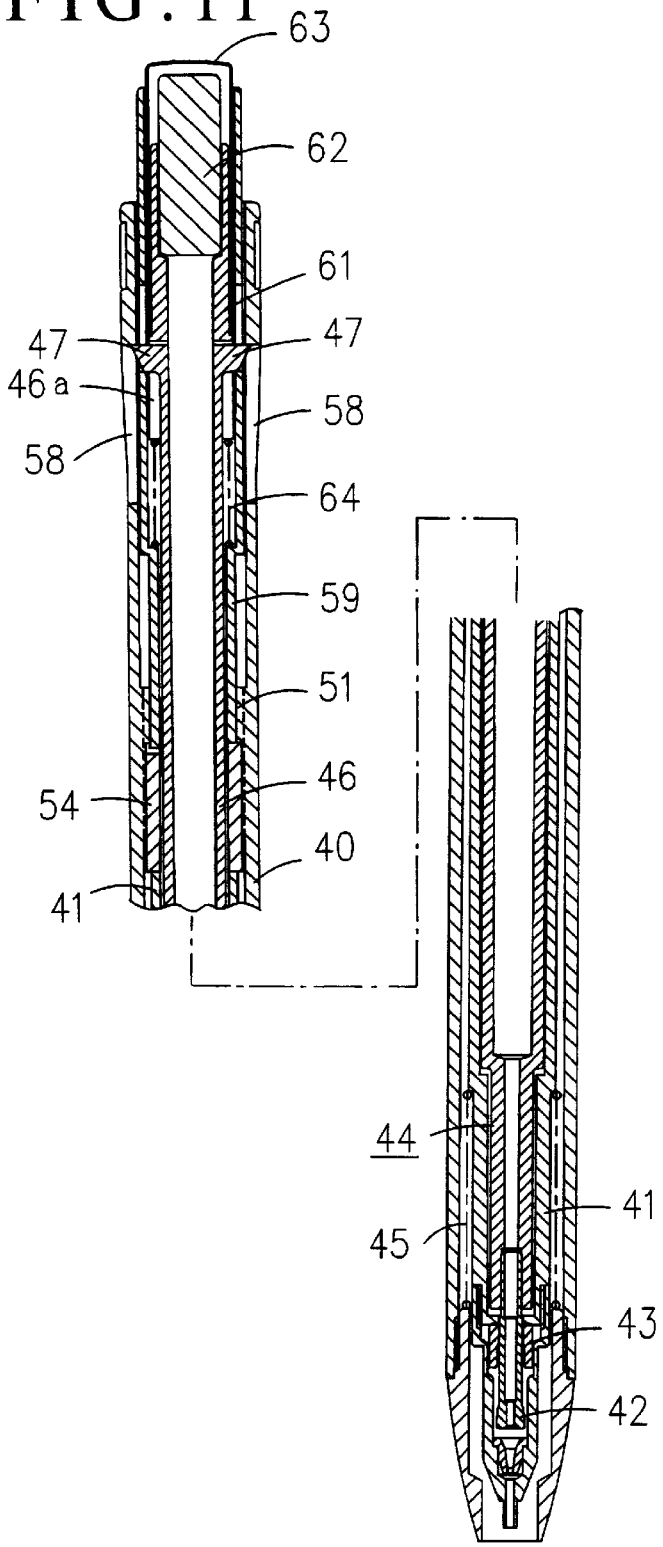
FIG. 11 is a vertical sectional view of a mechanical pencil according to a fourth embodiment of the present invention.
Figure 12:
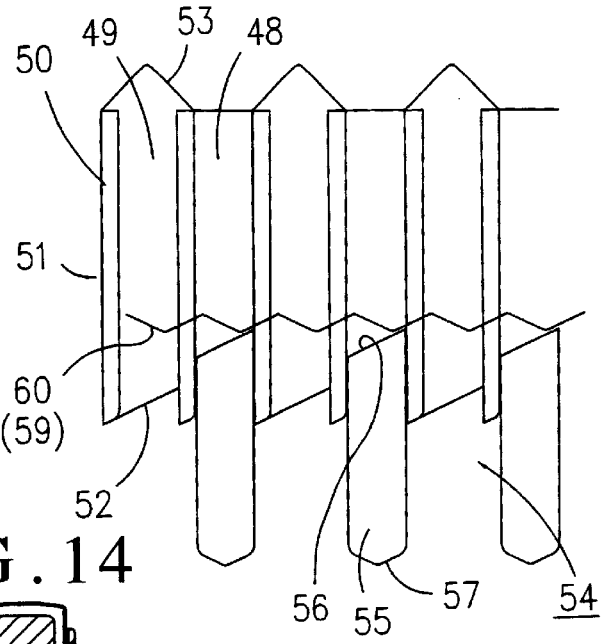
FIG. 12 is a development view showing a cam -mechanism of FIG. 11.

The third embodiment of the present invention will now be described with reference to FIGS. 9 and 10. A slider 35 having no slanted surface is in abutment with the rear end of the inner tubular shell 2, with a rear end of the slider 35 projected from the outer tubular shell 1. A wedge- like projection 36 is formed on a forward surface of the slider 35. This engagement projection 36 is allowed to project from a slit 37 formed in a side surface of the outer tubular shell 1 and engageable with an engagement retainer 39 of a clip 38 fixed to the outer tubular shell 1.

When the pusher body 26 and the slider 35 are pushed, the slider 35 is advanced along the slit 37. The advancement of the slider 35 causes the tip element on the tip portion of the inner tubular shell 2 to project from the tip member of the outer tubular shell 1. When the engagement projection of the slider 35 is brought into engagement with the engagement retainer 39 of the clip 38, the slider 35, the inner tubular shell 2, etc. are prevented from retracting. If it is desired that the slider 35 is retracted (withdrawn into the inner tubular shell 2), the clip 38 is opened to cancel the engagement between the engagement projection 36 and the engagement retainer 39. By doing so, the slider, the inner tubular shell, etc. are retracted (withdrawn) by the resilient force of a spring not shown.

The fourth embodiment of the present invention will now be described with reference to FIGS. 11 to 14. Easiness of assembly is intended in this embodiment. As in the preceding example of the outer tubular shell 40, the inner tubular shell 41 is slidably disposed. Within the inner tubular shell 41, a lead advancement mechanism 44, which includes a chuck body 42, a chuck ring 43, etc., is disposed. Reference numeral 45 denotes a resilient member such as a coil spring for biasing the inner tubular shell 41 backwardly.

A lead tank 46 for storing therein leads is press fitted into a rear part of the chuck body 42 of the lead advancement mechanism 44. One pair of inwardly resiliently deformable pawls 47 are provided on opposite positions of a rear part of an intermediate portion of the lead tank 46.

The outer tubular shell 40 has a cam face 51 formed on an inner surface of an intermediate portion thereof. There are deep groove portions 48, shallow groove portions 49 and projections 50 which are alternately continuously formed on the can face 51. The deep grooves 48 and the shallow grooves 49 of the cam face 51 are in the form of a through-hole formed all the way from their front ends to their rear ends. A slanted surface 52 is formed on a front end face of each of the shallow grooves 49 and a beveled slanted-surface 53 is formed on a rear end face thereof.

A rotor 54 is rotatably disposed on a front end of the cam face 51. A rear end of the inner tubular shell 41 is in abutment with a front end of the rotor 54. Vertical projections 55 are formed on a peripheral surface of the rotor 54. A slanted surface 56 is formed on a rear end face of each of the projections 55 and a beveled slanted- surface 57 is formed on a front end face thereof. The vertical projections 55 are slid along the corresponding deep grooves 48 or the slanted surfaces 56 are engaged with the corresponding slanted surfaces 52 of the cam face 51 so that the rotor 54 is prevented from making back and forth movements.

One pair of slits 58 are formed in opposite positions at a rear part of the outer tubular shell 40.

Behind the outer tubular shell 40, there is disposed a slider 59 for pushing and rotating the rotor 54, with a rear end of the slider 59 projected from a rear end of the outer tubular shell 40. A projection- like beveled slanted- surface 60 is formed on a peripheral surface of a front end of the slider 59 such that the rotor 54 is rotated when it is advanced. A rear part of the lead tank 46 is located within a front part of the slider 59 and a pusher portion 61 for pushing the lead tank 46 is located at a rear part thereof. The pusher portion 61 serves as a holder for holding an eraser 62. The pusher portion 61 also has a cover for protecting the eraser 62. In actual practice, this eraser cover 63 is projected and withdrawn from the rear end of the slider 59. Reference numeral 64 denotes a resilient member loaded between an enlarged diameter portion 46*a* of the lead tank 46 and the slider 59 and adapted to bias the slider 59 forwardly with a small force.

Figure 13:
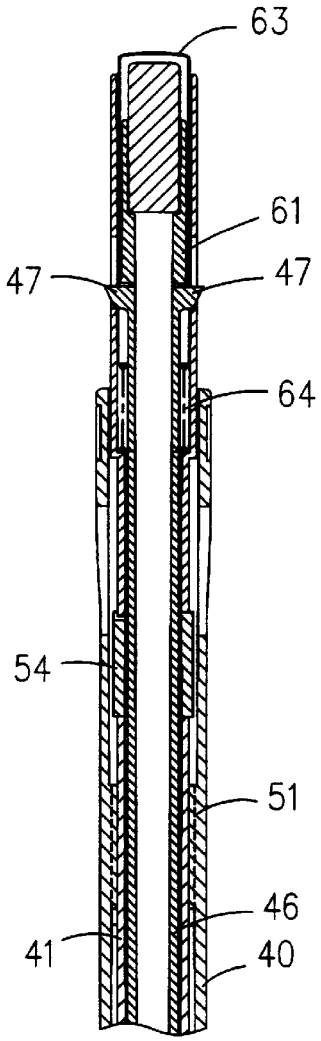
FIG. 13 is a vertical sectional view of an essential portion showing a process for assembly.
Figure 14:
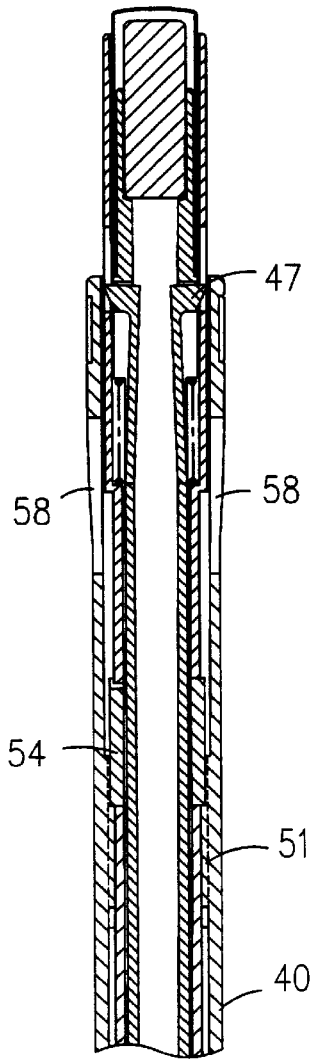
FIG. 14 is likewise a vertical sectional view of the essential portion showing a process for assembly.

A process for assembly will now be described with reference to FIGS. 13 and 14. In the preceding example, the lead advancement mechanism, the rotor, the slider etc. are assembled first from the front end of the outer tubular shell and then the pusher member is assembled from the rear end thereof In the present example, however, the inner tubular shell 41 having the lead advancement mechanism 44 is assembled first and in that state, the rotor 54, the resilient member 64, the slider 59 and the pusher member 61 are assembled to the lead tank 46. In other words, the internal mechanisms to be arranged within the outer tubular shell 40 are all assembled in advance. Then, the internal mechanisms are inserted from back of the outer tubular shell 40 (see FIG. 13). At that time, the pawl 47 of the lead tank 46 is inserted into the outer tubular shell 40 while narrowing inwardly (see FIG. 14) and brought into engagement with the vertical slit 58 of the outer tubular shell 40. By this engagement of the pawl 47 with the vertical slit 58, the assembling operation is finished (see FIG. 11). There may be a fear that when the internal mechanisms are inserted into the outer tubular shell 40, the front end face of the rotor 54 is abutted against the rear end of the cam face 51 to prevent the entry. However, the entry is easily made without being prevented because the beveled slanted- surfaces 53 and 57 are formed on the front and rear end faces (see FIG. 12) to correctly position the rotating rotor 52.

According to the first embodiment of the present invention, there is provided a slider type mechanical pencil having a plurality of cam grooves formed in an inner surface of an outer tubular shell, a rotor slidably/rotatably disposed within the cam grooves, and a slider for pushing and rotating the rotor, wherein an inner tubular shell having a lead advancement mechanism is disposed ahead of the rotor in abutment relation with the rotor, and a pusher member for sliding on an inner surface of the slider in order to push and rotate the rotor and actuating the lead advancement mechanism is disposed within the slider such that the pusher member can be projected from the slider.

According to the second embodiment of the present invention, there is provided a slider type mechanical pencil having an inner tubular shell slidably disposed within an outer tubular shell and containing therein a lead advancement mechanism, wherein a slider is disposed within the outer tubular shell with a part of the slider projected from a rear part of the outer tubular shell such that the slider is capable of pushing the inner tubular shell, and a pusher member for sliding on an inner surface of the slider and actuating the lead advancement mechanism is disposed within the slider such that the pusher member can be projected from the slider.

Owing to the features of the first and second embodiments described above, the large and small knocks can be selectively used with the feel of the user's finger in a reliable manner. Accordingly, a favorable sliding operation (advancement and retraction) and a favorable writing operation can be obtained.

What is claimed is:

1. A slider type mechanical pencil comprising: an outer tubular member having a front end and a rear end; an inner tubular member disposed in the outer tubular member for axial movement therein and having a lead advancement mechanism for axial movement within the outer tubular member to advance a pencil lead toward the front end of the outer tubular member; a slider having a first end portion projecting from the rear end of the outer tubular member and a second end portion, the slider extending into the outer tubular member so that the first end portion of the slider can be pressed in the axial direction relative to the outer tubular member to move the inner tubular member and the lead advancement mechanism in the axial direction toward the front end of the outer tubular member; and a pusher member extending into the outer tubular member for axial movement therein and having a first end portion projecting from the rear end of the outer tubular member and a second end portion, the pusher member extending into the slider so that in a first position of the pusher member the first end portion of the pusher member and the first end portion of the slider can be simultaneously pressed to move the inner tubular member and the lead advancement mechanism in the axial direction relative to the outer tubular member, and so that in a second position of the pusher member the first end portion of the pusher member projects from the first end portion of the slider and can be pressed to move the lead advancement mechanism in the axial direction relative to the slider, the inner tubular member and the outer tubular member to advance the pencil lead toward the front end of the outer tubular member.

2. A slider type mechanical pencil according to claim 1; wherein the pusher member has a pair of resilient lug portions for engaging a wall portion of the outer tubular member at the rear end thereof to prevent removal of the pusher member from the rear end of the outer tubular member.

3. A slider type mechanical pencil according to claim 2; wherein the slider has a pair guide grooves each for receiving a respective resilient lug portion of the pusher member.

4. A slider type mechanical pencil according to claim 1; further comprising means for maintaining the pusher member in the second position so that the pusher member can be pressed to move the lead advancement mechanism in the axial direction relative to the slider, the inner tubular member and the outer tubular member to advance the pencil lead toward the front end of the outer tubular member.

5. A slider type mechanical pencil according to claim 4; wherein the means for maintaining the pusher member in the second position comprises a cam disposed on an inner surface portion of the outer tubular member, and a rotor connected to the slider and having an engagement surface for engagement with the cam to limit the range of movement of the slider in the axial direction when the pusher member is in the second position.

* * * * *